United States Patent [19]

Satoh et al.

[11] 4,310,404

[45] Jan. 12, 1982

[54] ELECTROLYTIC BATH VESSEL ELEMENTS

[75] Inventors: Hiroaki Satoh, Tokyo; Yoshikazu Kokubu, Iwaki; Kiyoshi Kitagawa, Iwaki; Isao Okazaki, Iwaki, all of Japan

[73] Assignee: Kureha Kagaku Kogyo Kabushiki Kaisha, Tokyo, Japan

[21] Appl. No.: 94,689

[22] Filed: Nov. 15, 1979

[30] Foreign Application Priority Data

Nov. 17, 1978 [JP] Japan ..... 53/141861

[51] Int. Cl.[3] ..... C25B 9/00; C08K 9/00; C08K 7/02; H01M 2/00

[52] U.S. Cl. ..... 204/252; 204/279; 260/42.14; 260/42.17; 429/34

[58] Field of Search ..... 204/252–258, 204/263–266, 267–270, 279, 98, 128; 429/34–39; 260/42.17, 42.14

[56] References Cited

U.S. PATENT DOCUMENTS

| | | | |
|---|---|---|---|
| 3,752,757 | 8/1973 | Stephenson et al. | 204/256 |
| 4,053,385 | 10/1977 | Hirozawa | 204/254 |
| 4,107,023 | 8/1978 | Mentz | 204/269 |
| 4,124,478 | 11/1978 | Tsien et al. | 204/279 X |

FOREIGN PATENT DOCUMENTS

| | | | |
|---|---|---|---|
| 1468784 | 2/1967 | France | 204/270 |
| 1110791 | 4/1968 | United Kingdom . | |
| 1251641 | 10/1971 | United Kingdom | 260/42.17 |
| 1330485 | 9/1973 | United Kingdom . | |
| 1539987 | 2/1979 | United Kingdom . | |

*Primary Examiner*—Andrew Metz
*Assistant Examiner*—Donald R. Valentine
*Attorney, Agent, or Firm*—Fleit & Jacobson

[57] ABSTRACT

The invention resides in an electrolytic cell element representing a frame structure defining partially an anode chamber and a cathode chamber. The frame is composed of a carbon fiber-high polymer composite material.

14 Claims, 5 Drawing Figures

ELECTROLYTIC BATH VESSEL ELEMENTS

BACKGROUND OF THE INVENTION

This invention relates to electrolytic bath vessel elements.

As an example and as is commonly known, the mercury process, the diaphragm process and the ion exchange membrane process are known for producing chlorine, hydrogen and sodium hydroxide by the electrolytic treatment of an aqueous solution of sodium chloride.

The mercury process is executed nowadays in an almost closed system. However, the problem of atmospheric pollution has not yet completely been solved and a considerable public fear in this respect still remains. Thus, those skilled in the art direct their most concern towards the diaphragm process as well as the ion exchange membrane process, using no mercury.

However, a grave quality problem exists in the sodium hydroxide products of the diaphragm process to such a point that the products contain a larger amount of common salt than that of the mercury process. In addition, there is a further problem that the electrolytic energy cost is considerably high.

In recent decades, ion exchange membranes characterized by superior selective permeability have been developed and the process using these membranes has been profoundly investigated and found that it can solve the public pollution problem which is inherent in the other two processes above mentioned. It is said that the products quality and the energy consumption rate are at least equal to or even higher than the other conventional processes.

As the anode used in this process, a dimensionally stabilized one is normally employed, and the membrane is highly thin. Therefore, the inter-electrode distance must be precisely kept and maintained in the electrolytic bath vessel.

Therefore, the bath vessel, especially its frame structure, and its composing frame elements must have a sufficient dimensional stability and a high degree of rigidity. It is further necessary to provide the bath vessel and its frame elements with a better fabricability and a better anticorrosion performance so as to assure favorable working ability in contact with the reaction mixture as well as the products during the course of the electrolysis. It is further necessary for the electrolytic bath vessel elements to have an efficient antipollution performance in such a sense that any detrimental and deteriorative substance to the ion exchange membrane can not practically be solved out from the elements under consideration.

As for the conventional bath frame material, polypropylene added with a proper amount of calcium silicate is broadly used as was disclosed in Japanese Open Patent Specification Sho-51-72973. However, it has been experienced with this kind of material that the mechanical strength is insufficient and the deterioration of the ion exchange membrane is appreciable.

SUMMARY OF THE INVENTION

It is, therefore, the main object of the present invention to provide efficient electrolytic bath vessel elements which are highly rigid and durable and capable of solving-out any deteriorating substance to the ion exchange membrane.

These and further objects, features and advantages of the invention will become more apparent when read the following detailed description with reference to the accompanying drawings, in which:

Figure 1:
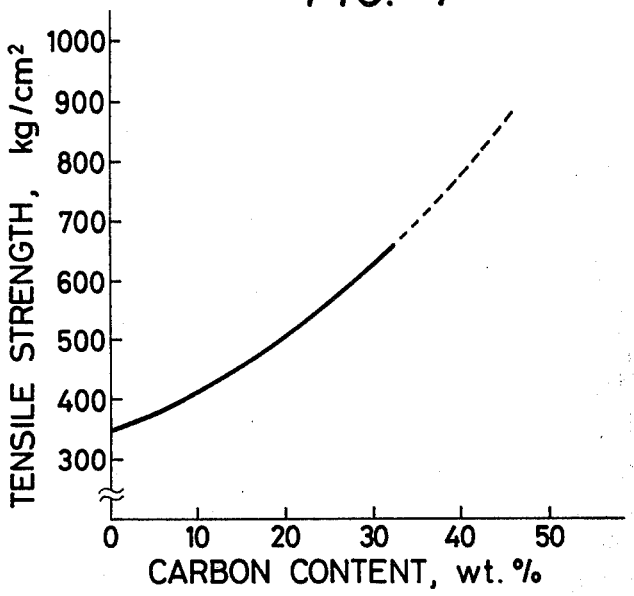
FIG. 1 is a diagram showing the tensile strength of carbon fiber-reinforced polypropylene composite material as a function of the carbon fiber content.

According to the invention, the electrolytic cell frame element is prepared from a carbon filament reinforced high polymer composite material, especially that of polypropylene (hereinafter referred to as "CFRPP"). This composite material is shaped into the cell frame elements by the molding process. When these cell frame elements are assembled together to provide a complete bath vessel comprising a series of cells, and used for the desired electrolytic service, it has been found that enough mechanical strength and anti-deterioration effect can be assured.

Before entering into detailed and specific description of the invention, we will provide certain preliminary information.

As is well known, the polypropylene is now broadly used as acid proof and alkali proof material in various fields, especially for the electrolytic cell elements under consideration, on account of its superior chemical stability. However, when electrolytic cell elements made of this polymer are used at the electrolytic temperatures, preferably 70°-95° C., adapted for the electrolytic treatment of aqueous solution of sodium chloride, it is experienced that the heat-resisting characteristic and the dimensional stability of this resin are insufficient for an extended electrolytic service. Cracks are frequently observed on the cell elements.

For avoiding these conventional drawbacks, we have made profound experiments on polypropylene polymer compositions compounded with various different fillers, especially filamentary fillers, and on their respective linear expansion coefficient, mechanical strength and anticreep performance. Tables 1-3 show these test results.

More specifically, Table 1 shows comparative mechanical properties of three kinds of polypropylene compositions compounded with calcium silicate fibers (wollastonite), glass fibers and carbon fibers, respectively. The compounding amount of the respective fibers amounted to 20 wt.%.

TABLE 1

| Reinforcing Fibers | Mechanical Characteristics: Tensile Strength, kg/cm$^2$ | Bending Strength, kg/cm$^2$ | Linear Expansion Coefficient,/°C. |
|---|---|---|---|
| Calcium Silicate Fibers | 200 | 310 | $12 \times 10^{-5}$ |
| Glass Fibers | 700 | 890 | $2.4 \times 10^{-5}$ |

TABLE 1-continued

| Re-inforcing Fibers | Mechanical Characteristics: Tensile Strength, kg/cm² | Bending Strength, kg/cm² | Linear Expansion Coefficient,/°C. |
|---|---|---|---|
| Carbon Fibers | 550 | 800 | $5.0 \times 10^{-5}$ |

Table 2 shows the respective corresponding anti-corrosion performances of these composite materials as determined experimentally under the practical electrolytic conditions of sodium chloride aqua-solution and as expressed in terms of strength-maintaining rates.

TABLE 2

| Re-inforcing Fibers | Anti-Corrosion Performance: Strength-Maintaining Factor, %, As Measured In The Anolytic Com: partment | Strength-Maintaining Factor, %, As Measured In the Catholytic Compartment |
|---|---|---|
| Calcium Silicate Fibers | 80 | 80 |
| Glass Fibers | 80 | 73 |
| Carbon Fibers | 89 | 95 |

Remarks:
Measured Before and After One-Month Electrolytic Operation

Table 3 shows the respective corresponding anti-pollution performance of these composite materials as determined under the practical operating conditions, being evaluated in terms of the solube-out velocities of multi-valent ions into the electrolytic solution.

TABLE 3

| Kind of Reinforcing Fibers | Anti-Pollution Performance Multi-valency Metal Ion (Ca;Mg) - Soluble-Out Velocity, mg/cm². hr: $Ca^{++}$ | $Mg^{++}$ |
|---|---|---|
| Calcium Silicate Fibers | $0.2\text{–}2 \times 10^{-2}$ | $0.0\text{–}0.5 \times 10^{-2}$ |
| Carbon Fibers | 0.0 | 0.0 |

It will be determined from these experimental results that the calcium silicate fiber-reinforced polypropylene composition is substantially inferior in its mechanical characteristics to the other two compositions listed above. In addition, it will be feared that certain degree of pollution of the electrolytic membranes may occasionally occur by the very presence of solube-out $Ca^{++}$-ions. On the other hand, the glass fiber-reinforced polypropylene composition represents substantially inferior mechanical strength to those of the other two composition materials listed above.

In consideration of these experimental results, we adopted, among others, the CFRPP-composition as the electrolytic cell frame material.

As will be more specifically described, highly favorable results have been obtained by using this novel composite material which is molded into the desired cell frames. These cell frames are then assembled together for use as the electrolytic frame assembly holding anodes, cathodes and ion exchange membranes.

It is preferable to mold the cell frame for purposes of increasing mechanical resistance thereof in such a way that the organic polymer is rather more enriched at and nearer to the surfaces of the cell frame when viewed from its inside.

As found from the test results of a continuous practical running with the cell frame assembly for six months, there were substantial differences in the electrolytic voltage among the aforementioned various materials. As an example, with the cell frames of calcium silicate fiber-reinforced polypropylene cell frames, considerable amounts of $Ca^{++}$- and $Mg^{++}$-ions were solved out, thereby the micropores of the membranes were clogged so that the electrolytic voltage increased substantially as the time elapsed. On the contrary, and with the CFRPP-composition-made cell assembly, there was substantially no rise of the electrolytic voltage even after a six month continuous operation, showing a remarkable stability of the electrolytic voltage. Upon precise observation of the last-mentioned cell assembly upon termination of the continuous six month running, the CFRPP-frames showed practically no defects and damage, thus assuring a longer continuous workability.

As the carbon fibers usable for reinforcing the cell frame according to this invention, those having diameters of 1–30μ and aspect ratios larger than 10 are used. These carbon fibers may preferably be surface-treated with a properly selected treating agent for increasing its affinity to the polypropylene.

For the surface treatment, that with silane may normally be preferred. For this purpose, and in no limiting sense, γ-aminopropyltrioxysilane; vinylethoxysilane or the like may be used. As the polypropylene usable in the present invention, any moldable kind of the polymer or copolymer may be utilized. A copolymer having as its main component the polypropylene may be blended with the polypropylene polymer. A chemically modified polypropylene may also be blended with the polypropylene polymer, for the purpose of improving the affinity to the reinforcing carbon fibers.

As the chemically modified polypropylene for this purpose, the polypropylene polymer or copolymer modified with organocarboxylic acid or the like modifier may be used.

As shown in FIG. 1, the tensile strength of CFRPP-composition will increase with increased quantity of the reinforcing carbon fibers. However, with a larger quantity than 60 wt.% of the carbon fibers, a substantial decrease of the overall melt index may disadvantageously be encountered, thus the practical moldability of the composition could be adversely influenced and a substantial inconvenience being imposed on the practical molding formation of the cell frame. In FIG. 3, the relationship between the melt index of the composition and the added quantity of the carbon fibers is shown, while in FIG. 2, the relationship between the linear expansion coefficient of the composition and the added quantity of the reinforcing carbon fibers is shown. With higher added quantity of the latter than 5 wt.%, the linear expansion coefficient will become disadvantageous-small, thereby the dimensional stability of the formed cell frame becoming highly reliable.

Figure 2:
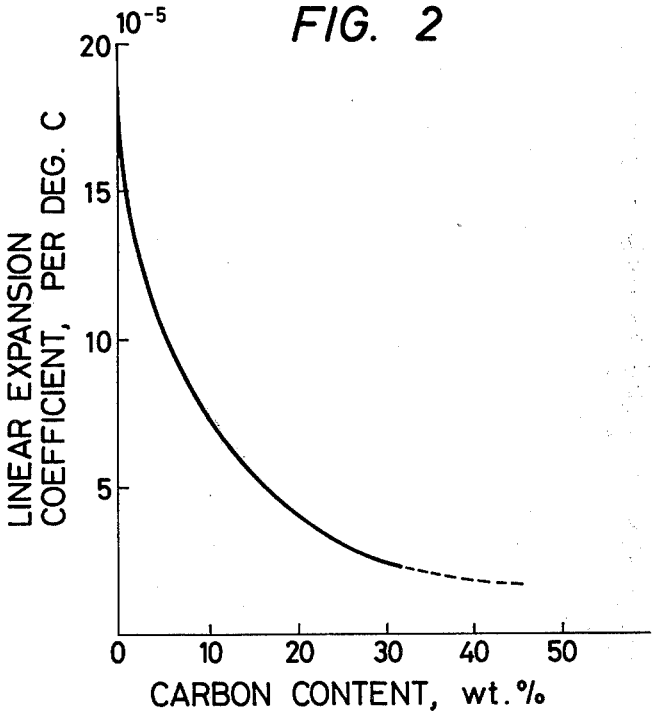
FIG. 2 is a diagram of the same carbon fiber-polypropylene composite material, showing its linear expansion coefficient plotted against the carbon fiber content.
Figure 3:
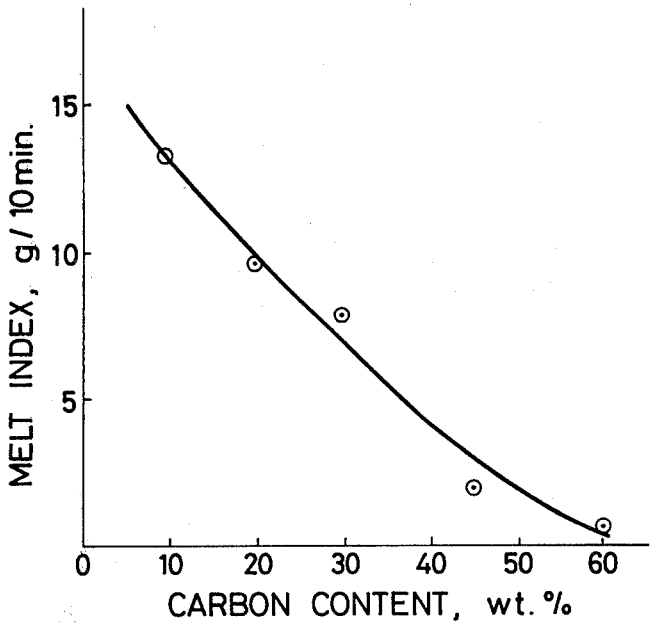
FIG. 3 is a further diagram showing the melt index of the same composite as measured as a function of the carbon fiber content.

From the results shown in FIGS. 1–3, it will be safely concluded that the added quantity of the reinforcing carbon fibers in the CFRPP-composition will range from 5 to 60 wt.%, and preferably from 10 to 40 wt.%, for the purpose of the present invention.

In the following, a preferred embodiment of the invention will be described with reference to FIGS. 4 and 5.

Figure 4:
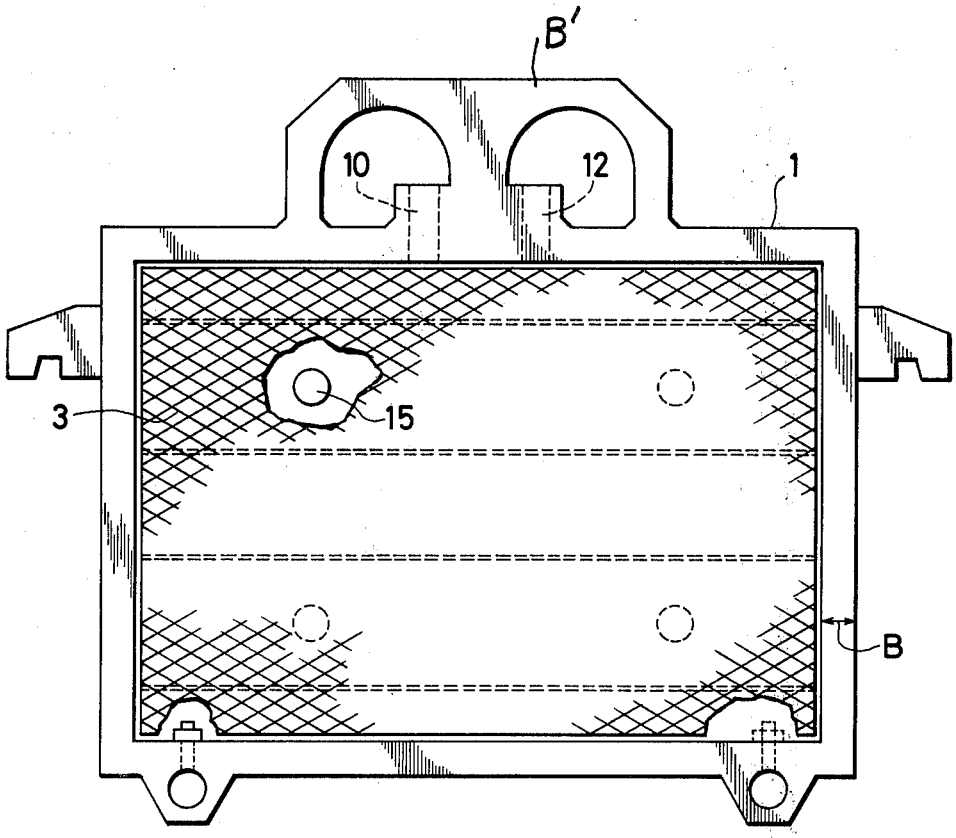
FIG. 4 is a front view of an embodiment of the frame element according to this invention.

Numerical Example 25 wt.% of carbon fibers, manufactured and sold by Kureha Kagaku Kogyo Kabushiki Kaisha, Tokyo, Japan under the tradename "M-107T"; 20 wt.% of polypropylene chemically modified with organo-carboxylic acid and manufactured and sold by Tonen Sekiyu Kagaku Kogyo Kabushiki Kaisha, Tokyo, Japan, under the tradename "CMP"; and 55 wt.% of polypropylene, manufactured and sold by Tonen Sekiyu Kagaku Kogyo Kabushiki Kaisha, Tokyo, Japan, under the tradename of "J-209", were compounded and molded into cell frames, as shown at 1 in FIG. 4. The cell frames were precisely examined with relation to their dimensions, reflection and surface smoothness. No extraordinary configuration and unacceptable surface conditions were found.

The frame element may have its outline dimensions of 1 m×1.5 m, as an example, with its width amounting to 13 cm. This width is shown at "A" in FIG. 5.

Figure 5:
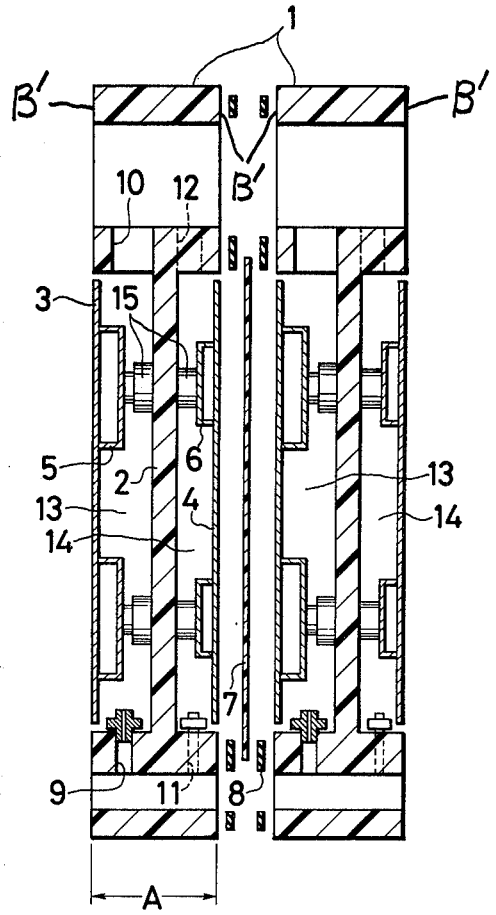
FIG. 5 is a longitudinal section of two of these frame elements which are illustrated as being ready for assemblying together.

The frame element is formed with a closed, substantially rectangular marginal plane surface for receiving a correspondingly shaped gasket shown only schematically in its cross-section at 8 in FIG. 5. As may be well seen from FIGS. 4 and 5 in combination, the gasketing surface B, having a width of 4–8 cm, has a relatively small eye holed extension shown at B'. The gasket 8 covers naturally this extended portion B'.

Main part of the frame element comprises a vertical separating wall or web 2, FIG. 5, for separating fluidically the both sides thereof from each other. At one side, left hand side in this case, of the separating wall and at a certain predetermined distance therefrom, an anode 3 is set in position. In the similar way, a cathode 4 is set in position at the opposite side, right hand side in this case, of the separating wall and at a certain predetermined distance therefrom.

The anode and the cathode of the same frame element are connected electrically with respective voltage sources, not shown, by means of a plurality of, four in the shown embodiment, rigid conductors 15 passing through the separating wall.

The anode 3 is a metal electrode, manufactured and sold by Pelmereck Electrode Co., under Registered Trademark "DSE", while the cathode 4 is an iron electrode having the same configuration of the anode, of perforation ratio: 50%; perforation being ½"×½", of diameter shape; thickness being 1.6 mm; and made of expand metal.

Direct mechanical connection between anode 3 and conductor piece 15 is made through a member 5 which is made of copper coated with a titanium layer. In the similar way, direct mechanical connection between cathode 4 and conductor piece 15 is made through a similar member which is made, however, of a combination of copper and iron.

Numeral 7 represents an ion exchange membrane made of "Nafion #324" manufactured and sold by DuPont, having a thickness of 300μ.

In order to complete the electrolytic vessel assembly, a number of frame elements 1 are assembled together in a horizontal line, although in FIG. 5, only two neighboring elements are shown in their separated, however, ready-for-assemblying position. As is shown in FIG. 5, an ion exchange membrane 7 is inserted between each two successive elements 1.

In this way and with each pair of frame elements in the thus compacted frame composition, there are provided an anodic chamber 13 and a cathodic chamber 14 at both sides of each membrane 7. Before compacting, a sheet of gasket 8 has been introduced between the membrane 7 and each of the frame elements, as shown in FIG. 5. This gasket sheet, preferably about 5 mm thick, may preferably be of natural rubber.

For the packaging job, each frame member fitted with the anode and the cathode firmly in position by electric welding or fusing, is placed horizontally on a working table, not shown, and the gasket sheet 8 is attached onto the element, called "cell", in position after applying evenly a proper amount of sticking agent. Then, the ion exchange membrane is put on the package element and held in position by a plurality of clips, not shown.

The same job is performed until the last frame element has been thus prepared. The compacting pressure at the gasketed surface amounts usually to 8–15 kg/cm$^2$.

The thus assembled electrolytic bath vessel assembly is connected as conventionally with electrolyte supply source; voltage source, liquid outlet piping and gas outlet piping.

Operation Example

To the series of anode chamber, a substantially saturated aqueous solution of sodium chloride, concentration: about 25 wt.%, pH 3, was charged, while, to the series of cathode chamber, an aqueous solution of sodium hydroxide, concentration about 20 wt.%, was charged. Then, the electrodes are charged with electric current at the rate of 30 A/dm$^2$ for carrying out the electrolysis.

The NaCl-solution was supplied through supply nozzles 9 to the anode chambers. Return NaCl-solution diluted by the electrolysis and the formed gaseous chlorine were discharged through the outlet nozzles 10. On the other hand, fresh water was fed through supply nozzles 11 to the cathode chambers. The thus formed sodium hydroxide and gaseous hydrogen were discharged through the outlet nozzles 12.

Under the equilibrium conditions among salt solution, sodium hydroxide aqueous solution, chlorine and hydrogen, operating voltage drop amounted to about 3.6 volts. The load was measured to 4.5 kiloamperes. The operating temperature was measured to 78°–85° C. The production efficiency measured on the sodium hydroxide to about 85%. The concentration of the formed sodium hydroxide was about 20%.

Under the above operating conditions, a six-month continuous running of the test plant was made. Several short interruptions in the operating service occurred, during each of which the bath temperature dropped to 30° C. However, the inventive cell frame did not show any appreciable deformation, breakage and the like. Electrodes, ion exchange membranes and the like were subjected to no troubles and disturbances.

Reference Example

Calcium silicate (wollastonite) 20 wt.%; polypropyleneacrylic acid copolymer, "D-561" manufactured and sold by Exon Inc., 30 wt.%; polypropylene copolymer ("#7525" manufactured and sold by Shell Chemical Corporation) 39 wt.%; EP-rubber 10 wt.%; carbon black 1 wt.%, were compounded together and molded into cell frame elements, in the similar manner as mentioned in the foregoing example.

Several tens of these elements were assembled together by boling into an electrolytic bath vessel as before, and a test run was made under similar operating conditions as before.

As a result of one month operation, the operating voltage rose by about 0.15 volt. During a further continuous running of the test plant for three months, a successive and gradual voltage rise was experienced. At the end of a four month continuous running, the operating voltage showed a rise of 4.2 volts.

The embodiments of the invention in which an exclusive property or privilege is claimed are as follows:

1. An electrolytic cell element comprising a frame structure partially defining an anode chamber and a cathode chamber, said frame structure being composed of a carbon fiber-polymer composite material wherein said polymer is polypropylene or a copolymer of polypropylene, the polymer being chemically modified with an organo-carboxylic acid to improve the affinity of said carbon fiber to said polymer.

2. The cell element of claim 1, wherein the cell element is a sodium chloride aqueous solution electrolysis cell.

3. The cell element of claim 1, wherein said carbon fiber content is 5–60 weight percent.

4. The cell element of claim 1, wherein said carbon fiber content is 10–40 weight percent.

5. An electrolytic cell element comprising a frame structure partially defining an anode chamber and a cathode chamber, said frame structure being composed of a carbon fiber-polymer composite material wherein said polymer is polypropylene or a copolymer of polypropylene, wherein said carbon fiber is surface treated to improve the affinity of said carbon fibers to said polymer.

6. The cell element of claim 5, wherein the carbon fiber content is 5–60 wt.%.

7. The cell element of claim 5, wherein said carbon fiber is surface-treated with a silane.

8. The cell element of claim 7, wherein said silane is aminopropyltrioxysilane or vinylethoxysilane.

9. The cell element of claim 5, wherein said composite material further includes a chemically modified polypropylene or its copolymer to further improve the affinity of said carbon fiber to said polymer.

10. The cell element of claim 9, wherein said chemically modified polymer is chemically modified with an organo-carboxylic acid.

11. The electrolytic cell element of claims 9 or 1, wherein said frame structure composite material is further composed of a blend of said chemically modified polymer, with a polymer selected from the group consisting of polypropylene, copolymers of polypropylene, and blends thereof.

12. The cell element of claim 5, wherein said carbon fiber content is 5–60 weight percent.

13. The cell element of claim 5, wherein said carbon fiber content is 10–40 percent.

14. The cell element of claims 1 or 5, wherein said carbon fiber has a diameter of 1–30 microns and an aspect ratio larger than 10.

* * * * *